US009279299B2

(12) United States Patent
Lovorn

(10) Patent No.: US 9,279,299 B2
(45) Date of Patent: Mar. 8, 2016

(54) SYSTEM AND METHOD FOR MANAGED PRESSURE DRILLING

(75) Inventor: James R Lovorn, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 374 days.

(21) Appl. No.: 13/818,583

(22) PCT Filed: Aug. 22, 2011

(86) PCT No.: PCT/US2011/048559

§ 371 (c)(1),
(2), (4) Date: Feb. 22, 2013

(87) PCT Pub. No.: WO2012/027245

PCT Pub. Date: Mar. 1, 2012

(65) Prior Publication Data

US 2013/0146357 A1 Jun. 13, 2013

Related U.S. Application Data

(60) Provisional application No. 61/377,164, filed on Aug. 26, 2010.

(51) Int. Cl.
*E21B 21/08* (2006.01)

(52) U.S. Cl.
CPC ..... *E21B 21/08* (2013.01)

(58) Field of Classification Search
CPC ..... E21B 21/08
USPC ..... 175/25, 38, 48
See application file for complete search history.

(56) References Cited

U.S. PATENT DOCUMENTS

| | | | | |
|---|---|---|---|---|
| 6,904,981 | B2 * | 6/2005 | van Riet | 175/66 |
| 7,044,237 | B2 | 5/2006 | Leuchtenberg | |
| 7,350,597 | B2 * | 4/2008 | Reitsma et al. | 175/66 |
| 7,395,878 | B2 * | 7/2008 | Reitsma et al. | 175/38 |
| 7,444,242 | B2 | 10/2008 | Proett et al. | |
| 7,562,723 | B2 * | 7/2009 | Reitsma | 175/72 |
| 7,610,251 | B2 | 10/2009 | Shayegi et al. | |
| 7,823,656 | B1 * | 11/2010 | Williams | 175/38 |
| 7,836,973 | B2 * | 11/2010 | Belcher et al. | 175/25 |
| 8,061,444 | B2 * | 11/2011 | Mullins et al. | 175/50 |
| 8,122,975 | B2 * | 2/2012 | Belcher et al. | 175/57 |
| 8,256,532 | B2 * | 9/2012 | Gray | 175/48 |
| 8,528,660 | B2 * | 9/2013 | Santos | 175/25 |

(Continued)

FOREIGN PATENT DOCUMENTS

WO 2007005822 A2 1/2007

OTHER PUBLICATIONS

European Search Report date mailed Oct. 1, 2015; European Patent Application No. 11820445.2.

*Primary Examiner* — Kenneth L Thompson
(74) *Attorney, Agent, or Firm* — McGuireWoods, LLP

(57) ABSTRACT

A method for controlling a downhole pressure during drilling comprises continually sensing in real-time at least one real-time fluid property of an input fluid to a well and of a return fluid from the well. A wellhead setpoint pressure is calculated in real-time that results in a predetermined downhole pressure at a predetermined location in the well, where the calculation based, at least in part, on the at least one continually sensed real-time fluid property. The flow of the return fluid is controllably regulated to maintain the calculated wellhead setpoint pressure.

17 Claims, 2 Drawing Sheets

(56) References Cited

U.S. PATENT DOCUMENTS

| | | | | |
|---|---|---|---|---|
| 8,567,525 | B2 * | 10/2013 | Reitsma | 175/48 |
| 2005/0092523 | A1 | 5/2005 | McCaskill et al. | |
| 2006/0207795 | A1 | 9/2006 | Kinder et al. | |
| 2007/0227774 | A1 * | 10/2007 | Reitsma et al. | 175/25 |
| 2007/0246263 | A1 * | 10/2007 | Reitsma | 175/38 |
| 2009/0159334 | A1 * | 6/2009 | Alberty | 175/40 |
| 2011/0139506 | A1 | 6/2011 | Lovorn et al. | |
| 2011/0139509 | A1 | 6/2011 | Pool et al. | |
| 2014/0041941 | A1 * | 2/2014 | Edbury et al. | 175/24 |

* cited by examiner

SYSTEM AND METHOD FOR MANAGED PRESSURE DRILLING

BACKGROUND

This application relates generally to the field of well drilling.

In many cases, the formation pore pressure gradient and the fracture pressure gradient increase with the true vertical depth (TVD) of a well. For each drilling interval, a mud density (mud weight or MW) may be used that is greater than the pore pressure gradient, but less than the fracture pressure gradient, such that a downhole mud, or drilling fluid, pressure lies between the pore pressure and the fracture pressure. In many cases, the difference, also called window, between downhole pore pressure and fracture pressure is sufficient so that the equivalent circulating density (ECD) of the drilling fluid remains within the allowable density window. The ECD, as used herein, is the effective density exerted by a circulating fluid against the formation that takes into account the pressure losses in the annulus above the point being considered. ECD comprises the static mud weight pressure at a depth location in the well added to the pressure losses of the return flow in the annulus between that depth and the surface and then converted to density units. A typical conversion between ECD and pressure at a downhole location is $$\text{ECD (in pounds per gallon, ppg)} = \text{annular pressure loss (in psi)} \div 0.052 \div \text{TVD (in ft)} + \text{current mud weight (in ppg)} \quad (1)$$

In some cases, it may be difficult to maintain the ECD within the allowable density window, for example due to an increased annulus pressure drop.

Models and systems for controlling the ECD may use physical and rheological properties of the drilling fluid to calculate various pressure losses in the drilling system. In some cases, the density and rheological properties of drilling fluids are measured manually and reported once, or twice, daily. These properties are then manually entered into the models to generate, at best, spot checks of dynamically changing fluid properties in the system. The accuracy of the models, in real time, is dependent on fluid properties that may have changed substantially since the last fluid property measurement.

BRIEF DESCRIPTION OF THE DRAWINGS

A better understanding of the present invention can be obtained when the following detailed description of example embodiments are considered in conjunction with the following drawings, in which.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward", "downhole" and similar terms refer to a direction away from the earth's surface along the wellbore. Terms such as "upstream" refer to the fluid flow direction back toward the pumps, while "downstream" refers to the flow direction toward the return pit.

In one example embodiment, a process is disclosed that utilizes real-time density and rheology sensors and their measurements to automatically feed real-time drilling hydraulics models. The hydraulics models may be used in a managed pressure drilling (MPD) system to control the annulus pressure gradient, the annulus ECD, and the static downhole pressure at a selected location in the wellbore.

In one embodiment, real-time fluid rheology and density measurements of drilling fluid may be continually taken on the inlet fluid to the well and the return fluid from the well. In one example, the measurements are supplied into hydraulic and cuttings transport software models. The hydraulics and cutting transport models calculate the pressure losses of the various downhole drilling system components, based at least in part on the types of equipment downhole. The models may determine an estimated setpoint wellhead pressure for controllably adjusting a flow control apparatus in the return flow line such that setpoint wellhead pressure results in a downhole pressure, in at least one portion of the annulus of the well, within the range between the pore pressure and the fracture pressure of the surrounding formation. One skilled in the art will appreciate that the pore pressure and fracture pressure may be site and depth dependent. For a given well and a location in the well, the values of pore pressure and fracture pressure may be at least estimated from at least one of: in situ measurement, previous well logs, offset well logs, and combinations thereof. Thus, for a predetermined location in a well, a downhole pore pressure and a downhole fracture pressure may be determined, or at least estimated.

Figure 1:
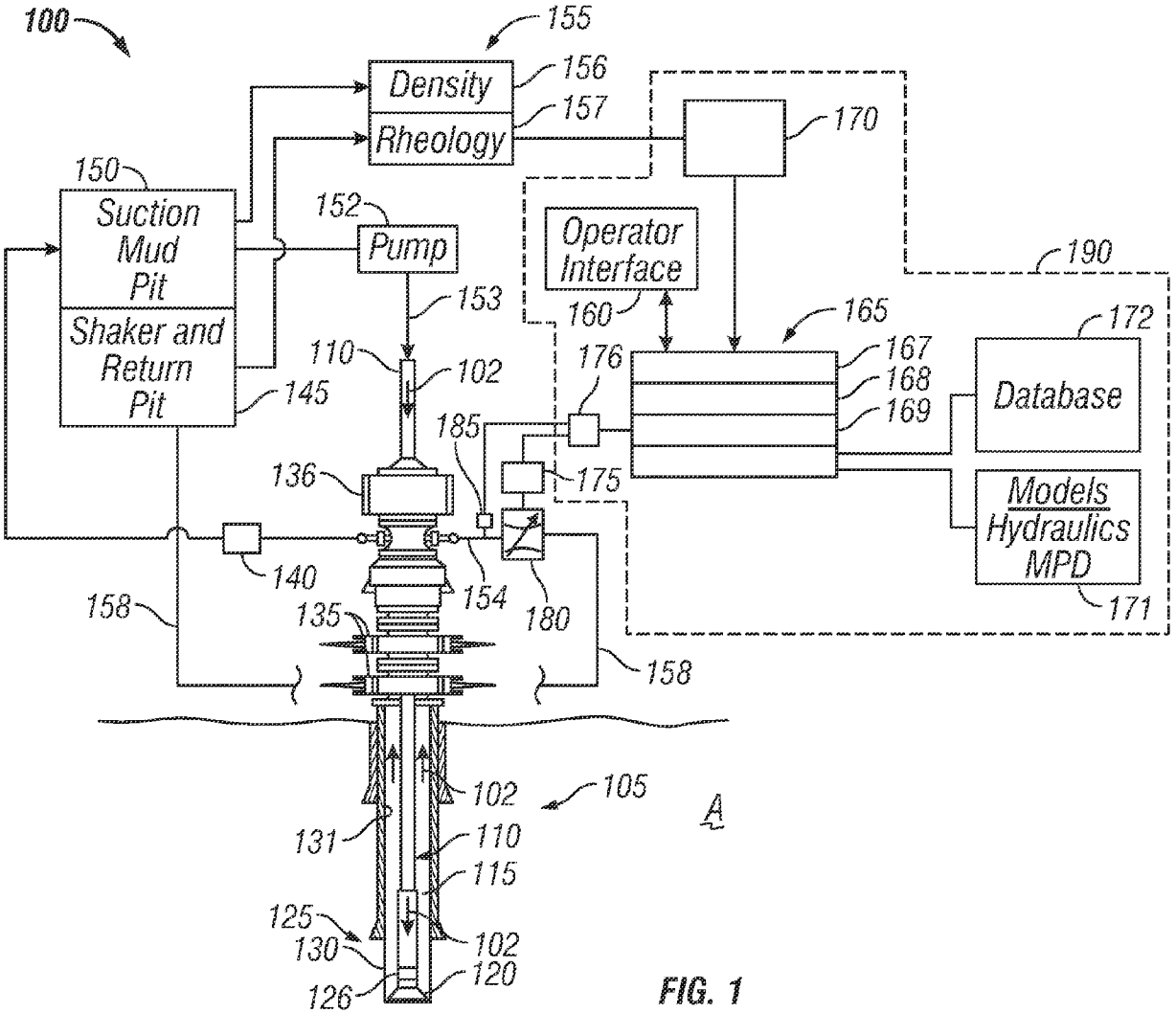
FIG. 1 shows one example of a system for controlling the wellbore pressure.

FIG. 1 shows one example of a system 100 for controlling a wellbore pressure in at least one portion of the annulus 115 of the well 105. A drill string 110 extends down into a wellbore 130, also called borehole, of the well 105 being drilled through at least one subterranean formation A. The drill string 110 may comprise jointed drill sections, coiled tubing, and wired pipe sections. The wellbore 130 may be drilled in any direction for example vertical, inclined, horizontal, and combinations thereof. The drill bit 120 may be coupled to the drill string 110 at a lower end thereof. A bottomhole assembly (BHA) 125 may be contained in the drill string 110. The BHA 125 may comprise measurement while drilling and/or logging while drilling tools (MWD/LWD), a mud motor, a hole reamer, one or more stabilizers, a steerable drilling assembly, and other suitable tools known in the art for drilling a well. A drilling fluid 102 is pumped through input line 153 and into drill string 110 by one or more pumps 152. The drilling fluid 102 travels down the interior of the drill string 102 and exits through the bit 120 into the annulus 115 between the drill string 110 and a wall 131 of the wellbore 130. As the drilling fluid 102 transits up the annulus 115, it picks up drilling cuttings from the drilling of the formation A and the properties of the drilling fluid 102 may be modified by the additional material.

In one example, a rotating pressure control device (RCD) 136 allows pressure containment in the wellbore 130 by closing off the annulus 115 between the wellbore 130 and the drill string 110, while still permitting the drill string 110 to advance into the wellbore and to rotate. The RCD 130 may be positioned above the blowout preventers (BOP's) 135 at the surface. The drilling fluid 102 may be circulated out of the wellbore 130 and exits between the BOP's 135 and the RCD 136.

Drilling fluid 102 flows through the return line 154 to a controllably adjustable flow control apparatus 180 (also called a controllably adjustable choke, herein) after exiting the wellbore 130. In one example, the controllably adjustable flow control apparatus 180 may comprise a controllably adjustable choke valve known in the art, for example the Automated Choke System provided by Halliburton Energy Services, Inc. of Houston, Tex., USA. A restriction to flow through the controllably adjustable choke 180 can be controllably adjusted by actuator 175 to vary the backpressure in the annulus 115. For example, a pressure differential across the choke 180 may be adjusted to cause a corresponding change in pressure applied to the annulus 115. Thus, a downhole pressure at a predetermined location (e.g., pressure at the bottom of the wellbore 130, pressure at a downhole casing shoe, pressure at a particular formation or zone, etc.) may be conveniently regulated by varying the backpressure applied to the annulus 115 at the surface. Actuator 175 may be electrically powered, hydraulically powered, pneumatically powered, or combinations thereof. Downstream of controllably adjustable flow control apparatus 180, drilling fluid 102 returns through line 158 to the return pit 145 where the cuttings are removed. Drilling fluid 102 then migrates back to suction pit 150 for another trip through the well flow system.

In one example, a hydraulics model can be used, as described more fully below, to determine a setpoint pressure that may be applied to the annulus 115 at, or near, the surface which will result in a downhole annulus pressure at a predetermined location within a predetermined pressure range. In one example, the predetermined pressure range is less than the fracture pressure and no greater than the pore pressure of the surrounding formation A. In another example, for underbalanced drilling, the predetermined pressure range is less than the pore pressure of the formation A at the predetermined location. An operator (or an automated control system) may operate the controllably adjustable flow control apparatus 180 to regulate the pressure applied to the annulus at the surface (which pressure can be conveniently measured) in order to obtain the desired downhole pressure.

In one embodiment, a real-time system, automatically and continually draws fluid samples from the suction pit 150 and the return pit 145 and inputs the samples into a real-time fluid properties testing module 155. The fluid properties testing module 155 may comprise a density measurement sensor 156 and a rheology sensor 157. In one example, the fluid samples may be regulated to a predetermined temperature and pressure before the fluid properties are measured. In one example, the density sensor 156 may be a coriolis type density sensor known in the art, for example the L-Dens line of density sensors from Anton-Paar Gmbh, Graz, Austria, or the like. In one example, the rheology sensor 157 may comprise an in line viscometer to measure rheological properties of the input and output drilling fluid 102. For example, the TT-100 line of inline viscometers manufactured by Brookfield Engineering Laboratories of Middleboro, Mass., or the like, may be used. Alternatively, where stabilization of the sample pressure and temperature is required, a continual batch process measuring system may be used. An example of such a batch process measuring system is the Real Time Density and Viscosity Measurement Unit available from the Baroid Division of Halliburton, Inc. In one example, separate real time fluid properties testing modules 155 may be used to test each of the input flow and return flow simultaneously. Rheological properties of interest of the input and return fluids include, but are not limited to: oil/water ratio, density, chlorides content, electric stability, shear stress of the fluid, gel strength, plastic viscosity, and yield point. In one example, shear stress comprises a plurality of shear rates, for example the typical six shear rate settings of common drilling fluid viscometers.

In one example, measurements from the sensors 156 and 157 may be transmitted to a real-time control system, also called a controller, 190. The controller 190 may comprise a data acquisition module 170 for interfacing sensor measurements to an information handling system 165. In one example, the real-time sensor measurements may be transmitted to the information handling system (IHS) 165 for use in real-time modeling and control of the controllably adjustable choke 180. For purposes of this disclosure, the IHS 165 may comprise any instrumentality, or aggregate of instrumentalities, operable to compute, classify, process, transmit, receive, retrieve, originate, switch, store, display, manifest, detect, record, reproduce, handle, or utilize any form of information, intelligence, measurements, or data for business, scientific, control, and other purposes. The IHS 165 may comprise random access memory (RAM) 168, one or more processing resources such as a central processing unit (CPU) 167, hardware and/or software control logic, read only memory (ROM), and/or other types of nonvolatile memory. Additional components of the IHS 165 may comprise one or more data storage devices, for example disk drives, one or more network ports for communicating with external devices as well as various input and output (I/O) devices 160, for example a keyboard, a mouse, and a video display. The IHS 165 may also comprise one or more buses operable to transmit communications between the various hardware components. In addition, the IHS 165 may comprise suitable interface circuits 169 for communicating and receiving data from sensors and/or the data acquisition module 170 at the surface and/or downhole. A suitable data acquisition module 170 and information handling system 165 for use as described herein in the controller 190 are marketed as SENTRY and INSITE by Halliburton Energy Services, Inc. Any other suitable data acquisition and information handling system may be used in the present system in keeping with the principles of this disclosure. Additionally, the controller 190 may have stored information in a database 172 interfaced to the IHS 165. For example, the database 172 may comprise data related to other rig sensors, well geometry, offset well historical data, and/or other drilling fluid parameters used in the models.

In one example, the IHS 165 has programmed instructions, including one, or more, real-time hydraulics software model 171 stored in the memory 168 that when executed may transmit control instructions to the controller module 176 to autonomously operate the actuator 175 to control the operation of the controllably adjustable choke 180, based, at least in part, on the real-time measured density and rheological properties of the drilling fluid 102. As used herein, the term autonomous is intended to mean automatically, according to programmed instructions, without the requirement for operator input. It should be noted that a manual override may be allowed without departing from the definition of an autonomous system, as used herein. In one example, the controller module 176 may be a programmable logic controller that accepts the wellhead pressure setpoint values from the IHS 165 and controls the controllably adjustable choke 180 to maintain that wellhead pressure. While the elements 170, 165, and 176 are depicted separately in FIG. 1, those skilled in the art will appreciate that any, or all, of them could be combined into a single element designated as the controller 190. Alternatively, many of the functions of IHS 165 may be contained in a stand-alone version of controller module 176.

Suitable hydraulics models comprise REAL TIME HYDRAULICS provided by Halliburton Energy Services, Inc. Another suitable model is provided by the International Research Institute of Stavanger, Stavanger, No, and yet another suitable model is provided by SINTEF of Trondheim, NO. In one example, the real-time hydraulics model 171 may receive notification from the IHS 165 that new density and rheology input data are available. The new data may be imported into the real-time hydraulics model 171 and used for calculating the pressure drops, also called losses, and pressure profiles throughout the closed flow system between the input pump 152 and the controllably adjustable flow control apparatus 180. Such a hydraulics model, as described above, may take into account changes in the fluid, for example cuttings loading and fluid compressibility, as it transits the flow system in the wellbore. Note that multiple volumes of drilling fluid, each with different properties, may be transiting the system at any time. The real-time hydraulics model 171 tracks each volume and uses the density and rheological properties associated with that fluid volume, to calculate the pressure drops associated with each volume of fluid as they progress through the closed flow system.

The pressure losses of the system may comprise pressure losses associated with the surface equipment, the drillstring 110, the BHA 125, the LWD/MWD tools 126, the hole reamers, the bit 120, and the annulus 115. The sum of the pressure losses will provide a calculated standpipe pressure. The annular pressure loss will be utilized by the MPD system by the following equation:

$$\text{Well Head Pressure (WHP)} = \text{Desired Downhole Pressure (DDP)} - \text{Hydrostatic Pressure} - \text{Annular Pressure drop} \quad (2)$$

The real-time hydraulics model 171 will calculate the hydrostatic pressures of the fluid based, at least in part, on compressibility, real-time rheology, and thermal effect of the wellbore. The hydraulics model 171 may generate a pressure profile in the well annulus that may be compared to the well pore pressure and fracture pressure at desired locations along the well. The calculated WHP setpoint will then be transmitted from the real-time hydraulics model 171 in IHS 165 to the controller module 176. The controller module 176 directs the actuator 175 to adjust controllably adjustable choke 180 to achieve a wellhead pressure at pressure sensor 185 approximately equal to the calculated setpoint pressure. As indicated above, the calculated setpoint pressure imparts a surface pressure on annulus 115 such that results in the DDP at a predetermined location along the annulus 115. As indicated above, the DDP may comprise a predetermined pressure in a range that is less than the fracture pressure and greater than, or equal to, the pore pressure of the surrounding formation A. In another example, for underbalanced drilling, DDP may comprise a predetermined pressure range that is less than the pore pressure of the formation A at the predetermined location. As the real-time density and rheological properties of the drilling fluid 102 change they are detected, and the new values are input into the real-time hydraulics model 171. The real-time hydraulics model 171 calculations are repeated, the pressure losses are recalculated, and a modified controllably adjustable flow control apparatus set point is calculated, and transmitted to controller 176 to adjust the surface pressure to achieve the desired downhole pressure at the predetermined location. In one example, back pressure pump 140 may be used to help maintain the calculated WHP, for example when there is little or no flow of drilling fluid 102. There is a continual two-way transfer of data and information between the real time hydraulics model 171 and the data acquisition module 170 and controller 176 through IHS 165. The data acquisition module 170 and IHS 165 operate to maintain a continual flow of real-time data from the sensors 156, 157 to the hydraulics model 171, so that the hydraulics model 171 has the information it needs to adapt to changing circumstances, and to update the desired wellhead setpoint pressure that results in a predetermined pressure at a predetermined downhole location. The hydraulics model 171 operates to supply controller 176 continually with a real-time value for the desired wellhead setpoint pressure that results in the desired downhole pressure at the predetermined location. One skilled in the art will appreciate that, as is common in the drilling art, the desired downhole pressure, formation fracture pressure, and formation pore pressure for a location in the well, may all be transformed to units of fluid density (ppg) using Equation 1. This facilitates the use of the ECD terminology used in the drilling art.

Figure 2:
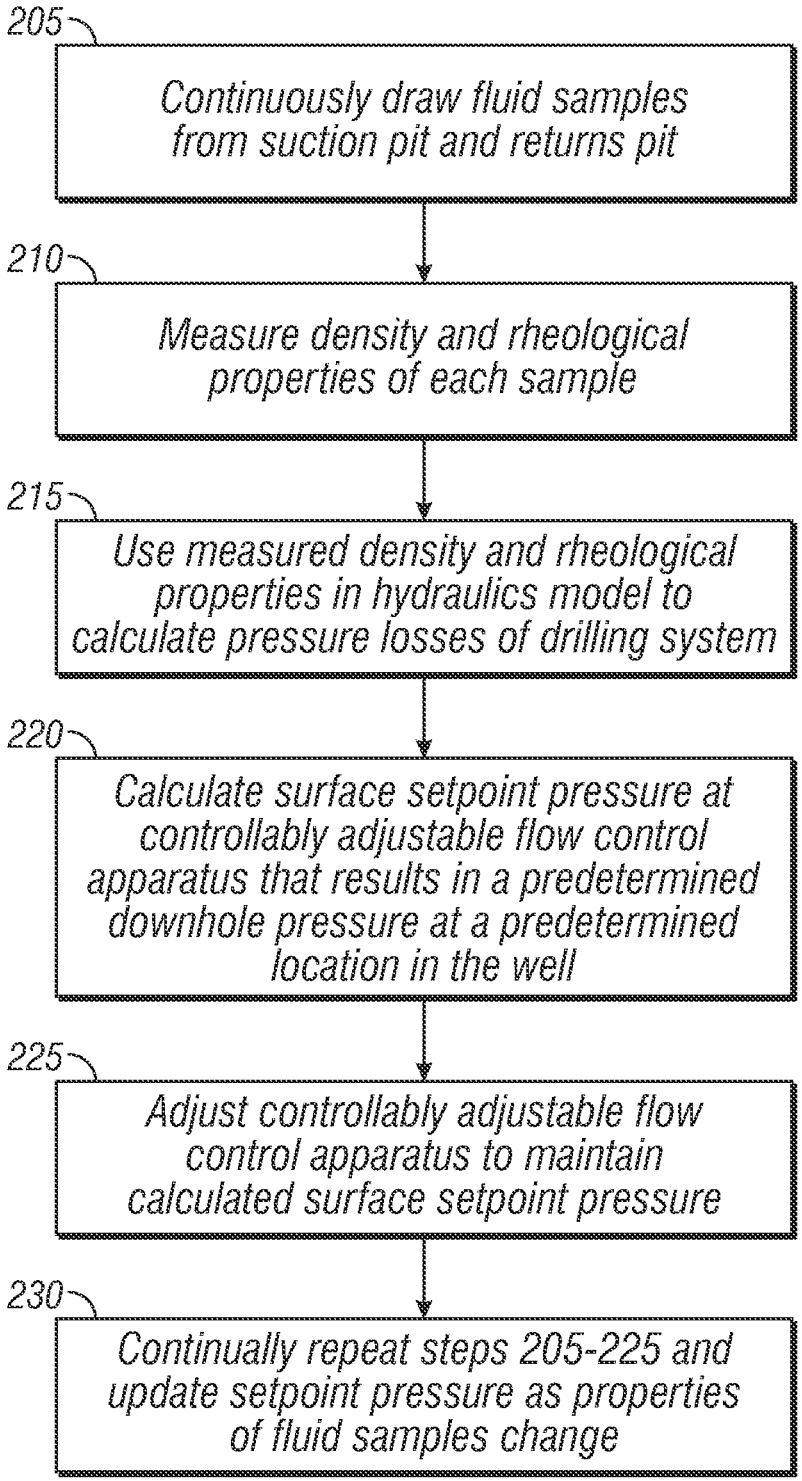
FIG. 2 shows a diagram for a method of maintaining a desired downhole pressure.

In one example, FIG. 2 shows a diagram for a method of maintaining a desired downhole pressure at a predetermined location in a wellbore. In the example, a fluid sample is continually drawn from each of the return pit 145 and the suction pit 150 in logic box 205. The density and rheological properties of each sample are measured in logic box 210. The measured density and rheological properties are used in a hydraulics model 171 to calculate pressure losses of the drilling system in logic box 215. The hydraulics model 171 calculates a desired surface setpoint pressure at the controllably adjustable flow control apparatus that results in a predetermined downhole pressure at a predetermined location in the well in logic box 220. The controllably adjustable flow control apparatus is adjusted to maintain the calculated surface pressure in logic box 225. The sequence is continually repeated and the setpoint adjusted as the properties of the fluid samples change in logic box 230.

While the process described herein is described as autonomous, so that no human interaction is required to control the setpoint pressure, human intervention may be used, if desired.

In one embodiment, the present disclosure may be embodied as a set of instructions on a computer readable medium comprising ROM, RAM, CD, DVD, hard drive, flash memory device, or any other computer readable medium, now known or unknown, that when executed causes an IHS, for example IHS 165, to implement a method of the present disclosure, for example the method described in FIG. 2.

The invention claimed is:

1. A drilling system for managed pressure drilling comprising:

at least one sensor to continually sense at least one real-time fluid property of an input fluid to a well and a return fluid from the well;

a controllably adjustable flow control apparatus disposed in a return flow line to regulate a flow of the return fluid; and a controller operably connected to the controllably adjustable flow control apparatus to instruct the controllably adjustable flow apparatus to regulate the flow of the return fluid to maintain a wellhead setpoint pressure based at least in part on the real-time sensed fluid property of the input fluid and the return fluid, wherein the at least one continually sensed fluid property comprises at least one of: fluid density, oil/water ratio, chlorides content, electric stability, shear stress, gel strength, plastic viscosity, yield point, and combinations thereof.

2. The drilling system of claim 1 wherein the at least one continually sensed fluid property comprises plastic viscosity.

3. The system of claim 1 wherein the controller comprises a processor in data communication with a memory, the memory containing programmed instruction that when executed calculates a surface well head setpoint pressure that results in a desired downhole pressure at a predetermined location, where the calculated wellhead setpoint pressure is based at least in part on the real-time sensed fluid property.

4. The system of claim 3 wherein the programmed instructions comprise a real-time hydraulics model of the well.

5. The system of claim 1, wherein the at least one sensor comprises at least one first sensor in hydraulic communication with the input fluid and at least one second sensor in hydraulic communication with the return fluid, the at least one first sensor and the at least one second sensor to operate substantially simultaneously on the input fluid and the return fluid respectively.

6. The system of claim 1 wherein the controller acts autonomously to adjust the controllably variable flow apparatus to regulate the flow of the return fluid to maintain the calculated wellhead setpoint pressure.

7. A method for controlling a downhole pressure during drilling comprising:

continually sensing in real-time at least one real-time fluid property of an input fluid to a well and of a return fluid from the well;

calculating in real-time a wellhead setpoint pressure that results in a predetermined downhole pressure at a predetermined location in the well, the calculation based at least in part on the at least one continually sensed real-time fluid property; and controllably regulating the flow of the return fluid to maintain the calculated wellhead setpoint pressure, wherein the at least one fluid parameter comprises at least one of: fluid density, oil/water ratio, chlorides content, electric stability, shear stress, gel strength, plastic viscosity, yield point, and combinations thereof.

8. The method of claim 7 wherein the at least one fluid parameter comprises fluid density.

9. The method of claim 7 wherein controllably regulating the flow of the return fluid further comprises autonomously controllably regulating the flow of the return fluid to maintain the calculated wellhead setpoint pressure.

10. The method of claim 7 wherein continually sensing in real-time the at least one fluid property comprises withdrawing a sample of the input fluid and the return fluid and regulating a temperature and a pressure of each sample to a predetermined temperature and a predetermined pressure before sensing the at least one fluid property.

11. The method of claim 7 wherein the predetermined downhole pressure is in a range that is less than a fracture pressure and greater than, or equal to, a pore pressure of a formation surrounding the well.

12. The method of claim 7 wherein the predetermined downhole pressure is less than a pore pressure of a formation surrounding the well.

13. A method for controlling an equivalent circulating density in a well comprising:

continually drawing in real-time a first fluid sample from an input fluid to a well and a second fluid sample from a return fluid from a well;

measuring in real-time a fluid density and at least one rheological property of each of the first fluid sample and the second fluid sample;

calculating a plurality of pressure losses along a closed flow system based at least in part on the measured fluid density and the at least one rheological property of the input fluid and the return fluid;

calculating a wellhead setpoint pressure that results in a predetermined downhole equivalent circulating density at a predetermined location based at least in part on the measured fluid density and the at least one rheological property; and controllably regulating the flow of the return fluid to maintain the calculated wellhead setpoint pressure.

14. The method of claim 13 wherein the at least one rheological property comprises at least one of: oil/water ratio, chlorides content, electric stability, shear stress, gel strength, plastic viscosity, yield point, and combinations thereof.

15. The method of claim 13 wherein the downhole equivalent circulating density at a predetermined location in the well results in a downhole pressure less than a fracture pressure and greater than or equal to the pore pressure of a formation surrounding the well at the predetermined location.

16. The method of claim 13 wherein controllably regulating the flow of the return fluid further comprises autonomously controllably regulating the flow of the return fluid to maintain the calculated wellhead setpoint pressure.

17. The method of claim 13 wherein measuring a fluid density and at least one rheological property comprises regulating a temperature and a pressure of each sample to a predetermined temperature and a predetermined pressure before sensing the at least one fluid density and the at least one rheological property.

* * * * *